US010650795B2

(12) United States Patent
Palmieri

(10) Patent No.: US 10,650,795 B2
(45) Date of Patent: May 12, 2020

(54) MAGNETIC PICKUP SYSTEMS FOR STRINGED INSTRUMENTS

(71) Applicant: Duneland Labs, LLC, Chicago, IL (US)

(72) Inventor: F. Robert Palmieri, Chicago, IL (US)

(73) Assignee: Duneland Labs, LLC, Chicago, IL (US)

( * ) Notice: Subject to any disclaimer, the term of this patent is extended or adjusted under 35 U.S.C. 154(b) by 0 days.

(21) Appl. No.: 16/157,851

(22) Filed: Oct. 11, 2018

(65) Prior Publication Data

US 2019/0108823 A1 Apr. 11, 2019

Related U.S. Application Data

(60) Provisional application No. 62/570,867, filed on Oct. 11, 2017.

(51) Int. Cl.

| | |
|---|---|
| ***G10H 3/18*** | (2006.01) |
| ***G10H 3/00*** | (2006.01) |
| ***G10D 1/08*** | (2006.01) |
| ***G10H 3/14*** | (2006.01) |

(52) U.S. Cl.

CPC ..... *G10H 3/181* (2013.01); *G10D 1/085* (2013.01); *G10H 3/143* (2013.01); *G10H 2220/505* (2013.01)

(58) Field of Classification Search

CPC .... G10H 3/18; G10H 3/181; G10H 2220/525; G10H 3/186; G10H 2220/505; G10H 3/182; G10H 1/32; G10H 2220/191; G10H 2220/201; G10K 11/004; G10K 2210/3229; G10G 5/00

See application file for complete search history.

(56) References Cited

U.S. PATENT DOCUMENTS

| | | | | |
|---|---|---|---|---|
| 4,394,830 | A | 7/1983 | Damiano | |
| 4,854,210 | A * | 8/1989 | Palazzolo | G10H 3/181 84/726 |
| 5,012,716 | A | 5/1991 | Pagelli et al. | |
| 5,530,199 | A | 6/1996 | Blucher | |
| D393,275 | S | 4/1998 | Andrenacri | |
| 5,767,431 | A * | 6/1998 | Khanagov | G10H 3/181 84/726 |
| 5,831,196 | A * | 11/1998 | Khanagov | G10H 3/181 84/726 |
| 5,883,322 | A | 3/1999 | Baker | |
| 5,894,101 | A * | 4/1999 | Damm | G10H 3/181 84/723 |
| 7,259,318 | B2 | 8/2007 | Chiliachki | |
| 2002/0069749 | A1 * | 6/2002 | Hoover | G10H 3/26 84/738 |

(Continued)

*Primary Examiner* — Marlon T Fletcher

(74) *Attorney, Agent, or Firm* — Hartman Global IP Law; Gary M. Hartman; Domenica N. S. Hartman

(57) ABSTRACT

A pickup system for an acoustic instrument having strings. The pickup system includes a mounting device configured to be coupled with an acoustic instrument, a sensing element secured to the mounting device and configured to convert mechanical vibrations produced by strings of the acoustic instrument into an electrical signal, and a secondary element secured to the mounting device and configured to reduce pickup of noise produced by sources other then the strings of the acoustic instrument.

21 Claims, 6 Drawing Sheets

(56) References Cited

U.S. PATENT DOCUMENTS

| | | | | |
|---|---|---|---|---|
| 2005/0204905 | A1* | 9/2005 | Chiliachki | G10H 3/181 84/728 |
| 2007/0084335 | A1* | 4/2007 | Silzel | G10H 3/143 84/723 |
| 2010/0005954 | A1* | 1/2010 | Higashidate | G10H 3/143 84/725 |
| 2014/0318350 | A1* | 10/2014 | Krasnov | G10H 3/143 84/726 |
| 2015/0294659 | A1 | 10/2015 | Chapman | |
| 2016/0049142 | A1* | 2/2016 | Radmacher | G10H 3/181 84/726 |

* cited by examiner

MAGNETIC PICKUP SYSTEMS FOR STRINGED INSTRUMENTS

CROSS REFERENCE TO RELATED APPLICATIONS

This application claims the benefit of U.S. Provisional Application No. 62/570,867, filed Oct. 11, 2017, the contents of which are incorporated herein by reference.

BACKGROUND OF THE INVENTION

The present invention generally relates to magnetic pickup systems for stringed acoustic instruments. The invention particularly relates to magnetic pickup systems that include one or more secondary elements intended to reduce extraneous induced noise.

Effective and appealing magnetic pickup systems for intrinsically acoustic instruments have stringent requirements, including but not limited to wide bandwidth, extremely low levels of hum and buzz, even string balance with strings that were not designed for magnetic sensing, low magnetic string pull, high output without the need for active electronics, light weight, and ease of integration with polarity switching. As such, there is an ongoing demand for magnetic pickup systems that improve upon one or more of these aspects.

BRIEF DESCRIPTION OF THE INVENTION

The present invention provides magnetic pickup systems capable of use with acoustic instruments having strings containing some measure of magnetically permeable material.

According to one aspect of the invention, a pickup system includes a mounting device configured to be coupled with an acoustic instrument, a sensing element secured to the mounting device and configured to convert mechanical vibrations produced by strings of the acoustic instrument into an electrical signal, and a secondary element secured to the mounting device and configured to reduce pickup of noise produced by sources other then the strings of the acoustic instrument. The sensing element includes a first coil wound about a first center point, and the secondary element includes a second coil wound about a second center point. The first coil of the sensing element is located within a perimeter of the second coil of the secondary element and the first and second center points are offset from one another.

According to another aspect of the invention, a pickup system for a stringed acoustic instrument includes a mounting device configured to be coupled with an acoustic instrument, a sensing element secured to the mounting device and configured to convert mechanical vibrations produced by strings of the acoustic instrument into an electrical signal, and a secondary element configured to reduce pickup of noise produced by sources other then the strings of the acoustic instrument. The mounting device is configured to be secured to the acoustic instrument to locate the sensing element beneath the strings of the acoustic instrument. If the acoustic instrument is equipped with a sound hole, the mounting device can be configured to be removably placed in the sound hole to locate the sensing and secondary elements over, within, or beneath the sound hole and beneath the strings of the acoustic instrument. If the acoustic instrument lacks a sound hole, the mounting device can be configured to suspend the secondary element from a pick guard or finger rest of the acoustic instrument and locate the sensing element beneath the strings of the acoustic instrument.

Technical effects of the systems described above preferably include the ability to conveniently and reliably locate a pickup system on a stringed acoustic instrument. The pickup system can have a variety of configurations for arranging the sensing and secondary elements individually and relative to each other.

Other aspects and advantages of this invention will be better appreciated from the following detailed description.

DETAILED DESCRIPTION OF THE INVENTION

FIGS. 1 through 15 represent embodiments of systems and components intended for use with acoustic instruments with strings that contain some measure of magnetically permeable material, including but not limited to guitars. In particular, the components may be used in magnetic pickup systems for recording and amplification applications. Systems comprising the components and configurations disclosed herein may result in improved signal quality and reduced feedback relative to conventional magnetic pickup systems.

The systems disclosed herein preferably include a mounting device configured to be secured to a stringed acoustic instrument and provide a housing or mounting surface for other components of the system, for example, a volume control and/or output lead or jack. A sensing element secured to or with the mounting device may comprise magnets and an oblong wire coil mounted in such a way as to be placed beneath the strings of the instrument to transduce fluctuations in a magnetic field caused by the motion of the strings of the instrument. As such, the sensing element is configured to convert mechanical vibrations produced by strings of the instrument into an electrical signal for subsequent amplification or other electronic processing. The sensing element can preferably be adjusted for balancing the output of the various strings by means of varying the flux along its span with a combination of magnet strengths, sizes, and placements.

The systems preferably also include one or more secondary elements intended to reduce or cancel noise from the ambient environment, that is, to reduce pickup of noise produced by sources other then the strings of the instrument. The secondary elements may include a wire coil having fewer turns than the sensing element, and in some cases wound in a manner that maintains a common (e.g., turns× area) product in conjunction with inverse relative polarity between the coil of the sensing element and the coil of the secondary element.

Figure 1:
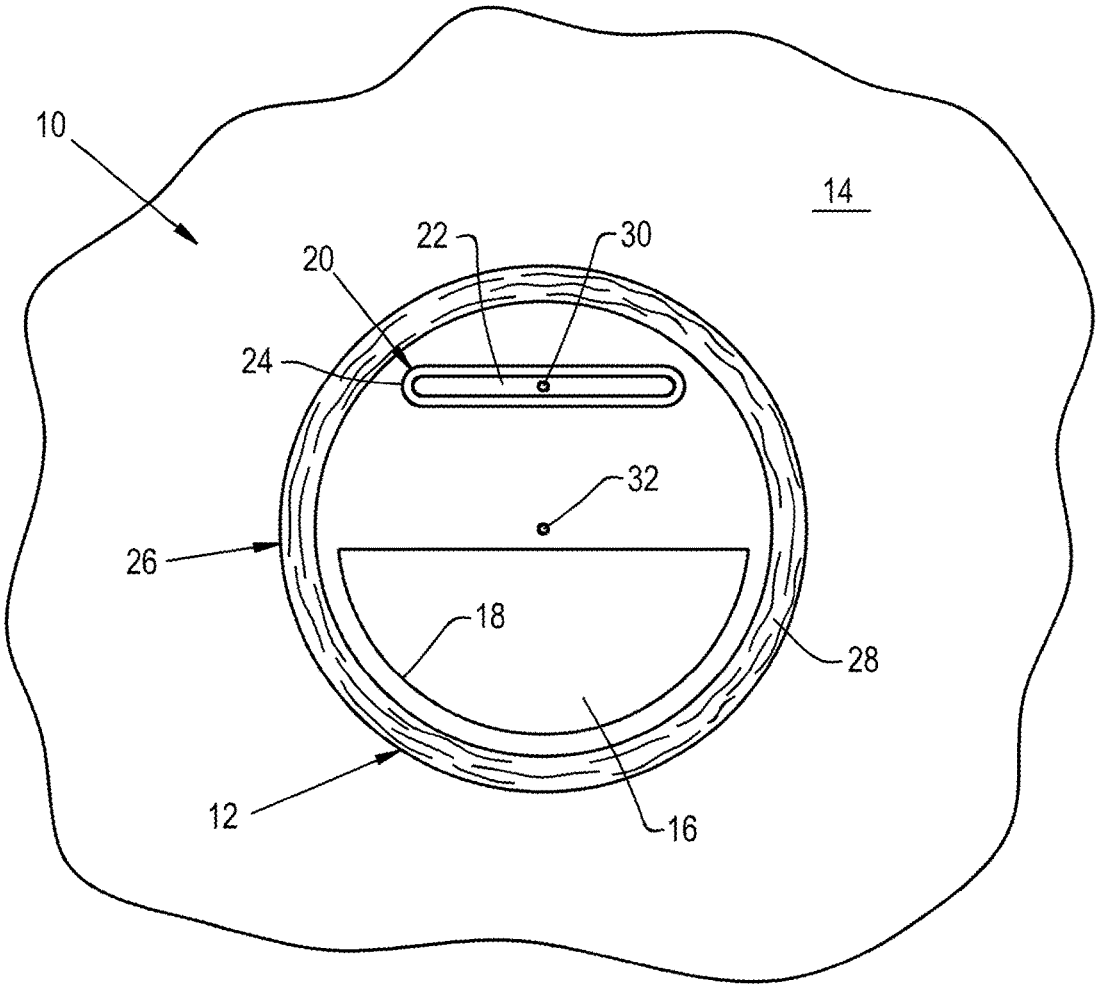
FIG. 1 schematically represents a first embodiment of a magnetic pickup system intended for use with a stringed acoustic instrument having a sound hole.
Figure 2:
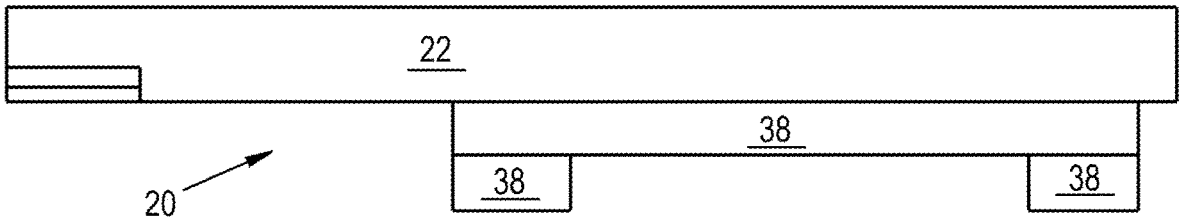
FIGS. 2 through 9 show nonlimiting examples of coil and magnet arrangements that may be used to construct a sensing element of a magnetic pickup system.
Figure 3:
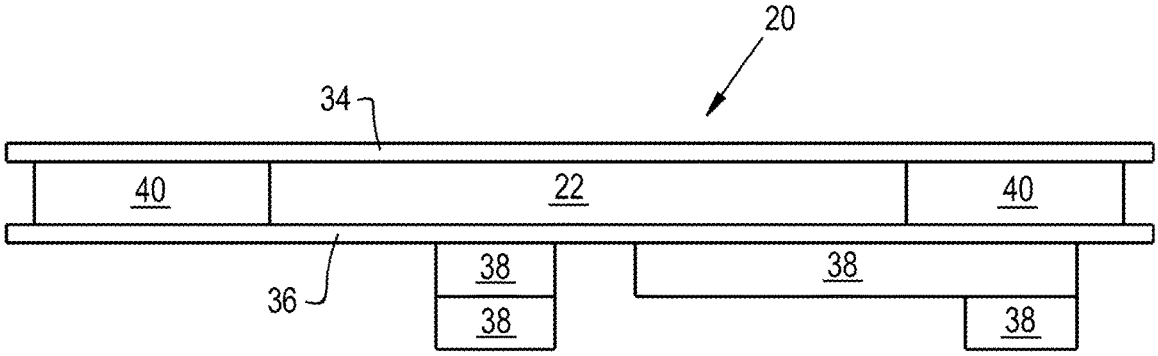
Figure 4:
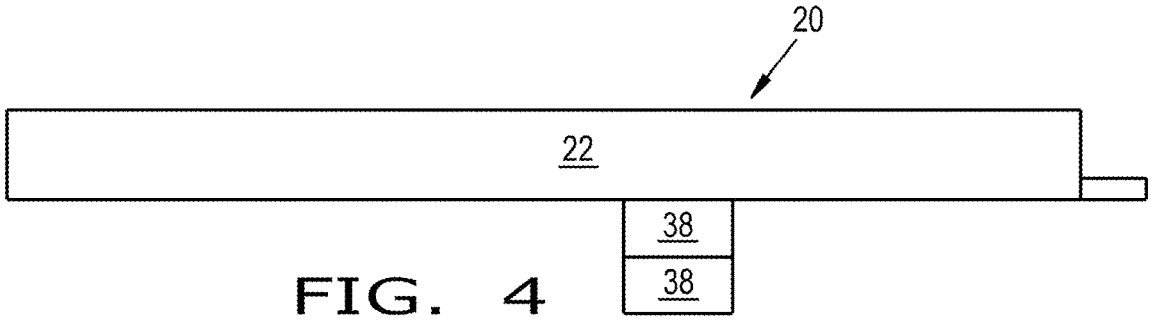
Figure 5:
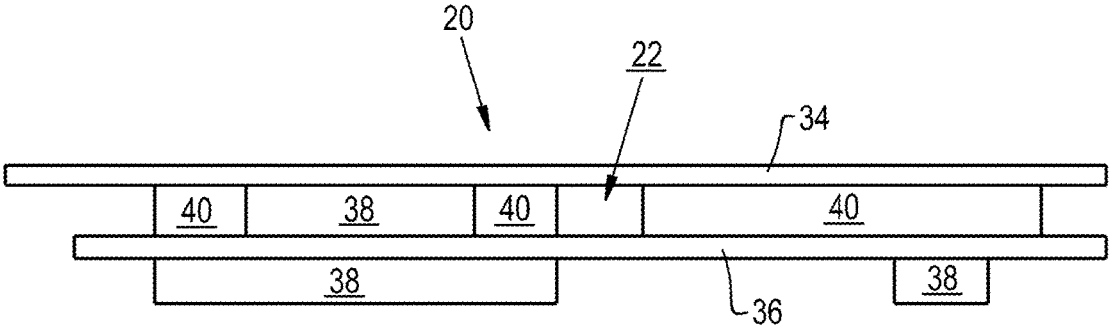
Figure 6:
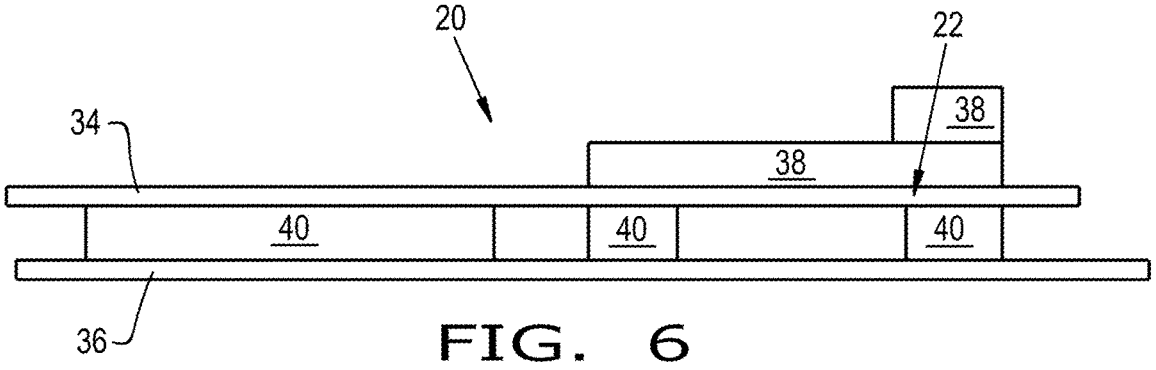
Figure 7:
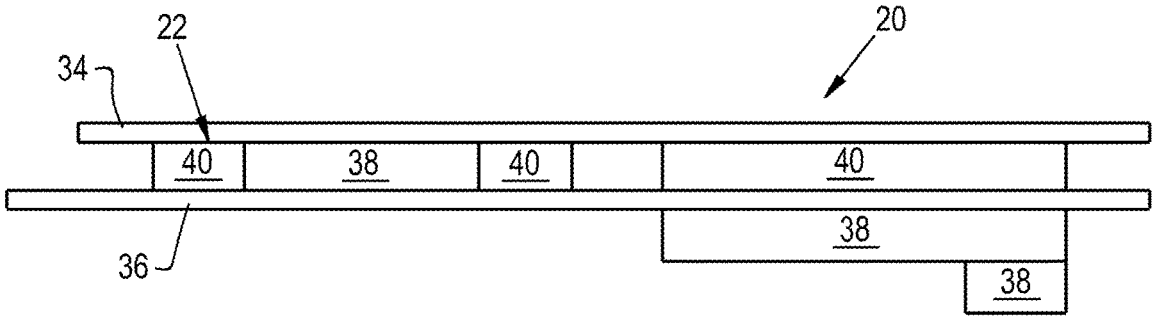
Figure 8:
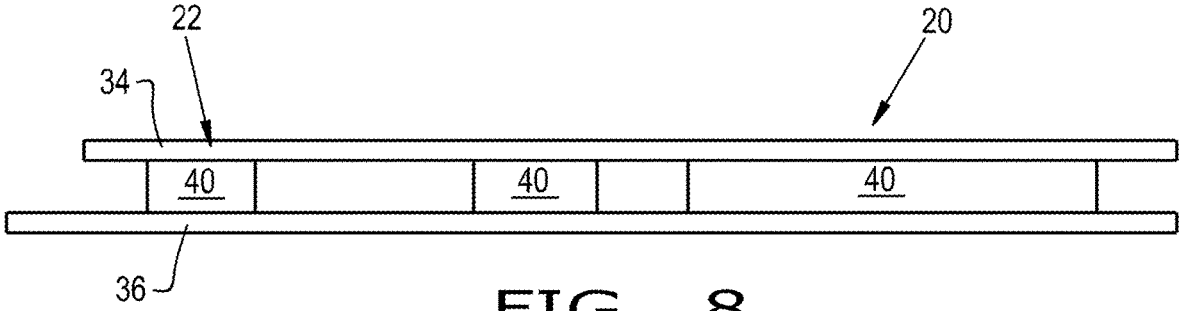
Figure 9:
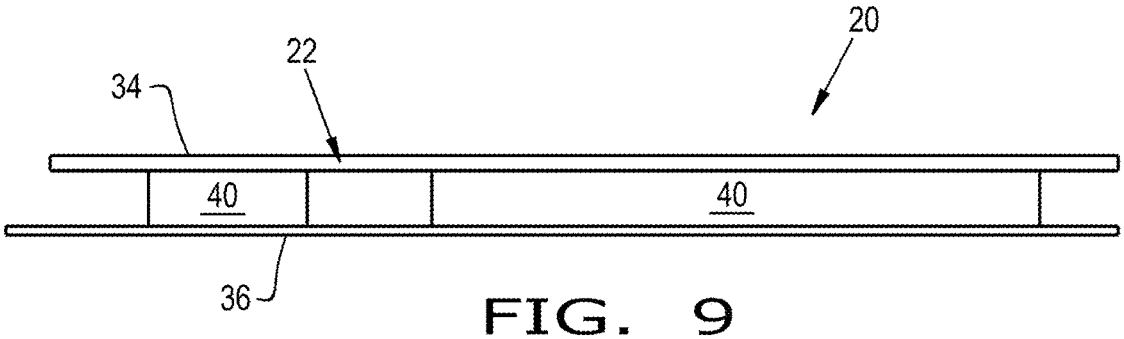

FIG. 1 schematically represents a first nonlimiting embodiment of a magnetic pickup system 10 adapted to convert the mechanical vibrations produced by strings into an electrical signal that can be amplified. The system 10 is particular suitable for use with stringed instruments, such as but not limited to a flat top acoustic guitar with a sound hole. For convenience, the embodiment of the system 10 represented in FIG. 1 will be discussed in reference to a stringed instrument with a circular sound hole, though it should be apparent that the system 10 may be configured to couple with sound holes of other shapes.

The system 10 is represented in FIG. 1 as including a disc-shaped mounting device 12 sized and shaped to be inserted into and/or cover the opening of a common round sound hole in an acoustic instrument 14, for example, in the case of guitars typically about 3.75 to 4 inches in diameter. The mounting device 12 can be configured to be removably secured to the instrument 14. The mounting device 12 may be sized and shaped to entirely close the sound hole, in which case the mounting device 12 preferably includes a closure 16, for example, a door, window, plug, etc., the inclusion or disposition of which can be configured to allow or restrict exchange of air through the sound hole between the inside and outside of the body of the instrument 14. In this manner, the closure 16 can be used to selectively expose or seal a passage 18 in the mounting device 12, the latter of which can be effective to suppress feedback caused by air exchange between the interior and exterior of the instrument 14, for example, when the instrument 14 is used in higher volume amplification applications. The mounting device 12 can be fabricated using a wide variety of fabrication processes, for example, 3-D printing processes, and can be constructed from a wide variety of materials, including transparent materials capable of revealing any decorative elements on the top surface of the instrument 14 surrounding the sound hole.

FIG. 1 represents an oblong sensing element 20 as spanning a chord of the disc-shaped mounting device 12. The sensing element 20 comprises a core 22 and a wound coil (referred to hereinafter as the sensing coil 24) configured for use as a transducer. Permanent magnets (not shown) of various materials (impregnated rubber, rare earth, aluminum-nickel-cobalt alloys (e.g., Alnico), ceramic, etc.) can be placed in, above, or beneath the core 22. These magnets may be arranged in various manners depending on the desired level and timbre of the individual strings.

FIG. 1 represents a secondary element 26 as completely surrounding the sensing element 20. The secondary element 26 includes a second wound coil (referred to hereinafter as the secondary coil 28) that is wound around the periphery of the outer circular shape of the mounting device 12. In this embodiment, the secondary element 26 and its coil 28 serve to cancel stray magnetic activity, usually characterized as noise in audio applications, and as such may be referred to as a cancellation element and cancellation coil, respectively. Since the secondary coil 28 has a significantly larger perimeter than the coil 24 of the sensing element 20, it can function to cancel unwanted electromagnetic fields. As discussed previously, the secondary coil 28 may be wound in a manner that maintains a common (e.g., turns×area) product in conjunction with inverse relative polarity between the secondary coil 28 and the sensing coil 24, though those of ordinary skill in the art will appreciate that the common turns×area product between the sensing and secondary coils 24 and 28 is not required to be exactly the same. Therefore, it will have far fewer turns than for the coil 24 of the sensing element 20 due to the larger area enclosed. Conventionally, such secondary elements 26 are permanently embedded in the body of the instrument 14 and sometimes require considerable excavation of material to be most effective. In contrast, the system 10 of FIG. 1 provides the secondary coil 28 on the mounting device 12 and therefore may significantly simplify installation relative to conventional magnetic pickup systems.

FIG. 1 represents the sensing element 20 as having a center point 30 (e.g., axis about which the sensing coil 24 is wound) that is displaced from the central axis of the mounting device 12, which coincides with the center point 32 of the secondary coil 28. In other words, the coils 24 and 28 are offset or non-coaxial with respect to each other. This configuration allows the sensing element 20 to be placed closer to the end of the instrument's fingerboard, a location which has desirable properties for tonal balance, and also allows for the optional inclusion of the closure 16 for control of feedback or adjustment of acoustic properties. As such, the pickup system 10 is uniquely adaptable to a wide variety of magnetic and acoustical sensing tasks for a wide variety of instruments.

FIGS. 2 through 9 show various nonlimiting examples of arrangements of sensing coils 24 and magnets that may be used for the sensing element 20. In each case, the sensing element 20 is configured as what can be referred to as a bobbin comprising a core 22 sandwiched between two panels 34 and 36, forming a bobbin that can be easily wound with common magnet wire to form the sensing coil 24. The sensing coil 24 is omitted in FIGS. 5 through 9 to reveal the core 22. FIGS. 2 through 7 show one or more magnets 38 located outside the core 22 and mounted to one of the panels 34 and 36, and FIGS. 5 through 9 show one or more magnets 38 located within the core 22 between the panels 34 and 36. FIGS. 5 through 9 also show inert materials or air spaces 40 located within the core 22 between the panels 34 and 36. FIGS. 2 through 9 show combinations of inert elements 40 (e.g., formed of magnetically inert materials such as impregnated rubber, air, and/or wood) in the cores 22 of the bobbins, which are locally supplemented in specific string sensing areas by magnets 38 above and/or below the panels 34 and 36, providing levels of adaptability that allow for individual designs to be easily adapted to the requirements of different strings and instruments. In addition to eliminating the need for a separate bobbin, this construction method also allows for the sensing coil 24 to be wound directly onto the components (e.g., 38 and 40) of the core 22, thereby increasing efficiency and maximizing options for turns count, wire gauge, and insulation type within the necessary outside dimensions of the sensing coil 24.

Low inductance (for extended high frequency response) in concert with high output can be achieved by insuring that the core 22 of the sensing element 20 is essentially non-permeable. To this end, fully saturated magnets 38, inert elements 40, or air spaces may be used as materials for the core 22 of the sensing element 20, as shown in FIGS. 2 through 9. The elimination of permeable elements from the core 22 can allow for calibration of the secondary coil 28 by using the well-known principle of establishing a common turns×area product between the sensing and secondary coils 24 and 28 with options for variations determined by the necessity for resistivity compensation. FIGS. 2 through 9 further show the bobbins as utilizing appropriately shaped strips of single-sided circuit boards as the panels 34 and 36. The strength and stiffness of conventional circuit board materials enable the use of very thin panels 34 and 36, for example, about 0.012 to about 0.030 inch, which facilitates positioning the sensing coil 24 in close proximity to the strings, therefore maximizing efficiency and output without necessitating excessive magnetic flux. The panels 34 and 36 formed by circuit boards can be assembled to form bobbins so that conductive (copper) layers conventionally present on circuit boards are located on the exterior surfaces of the panels 34 and 36, providing convenient elements for grounding and electrostatic shielding. Electrostatic shielding can be provided by a combination of the conductive layers on the panels 34 and 36, as well as other components comprising a Faraday shield, such as copper foil. The dielectric properties of conventional substrate materials of circuit boards minimize capacitive losses between the coil and copper elements of the sensing element 20. In addition, small islands of copper can be defined by etching copper layers on the circuit boards (panels 34 and 36) surface and subsequently used to terminate the ends of the sensing coil 24 and couple them to robust leadout wires for connections to other elements of the pickup system outside of the sensing element 20 and its coil. In this way, the terminations of the sensing coil 24 can also be isolated from the shielding and grounding elements, thereby facilitating easy integration with an onboard switch for polarity inversion. This feature is very helpful both for minimizing acoustic feedback between the instrument and amplifier and also in establishing coherent behavior between the instrument's vibrating elements and speaker elements driven by an amplifier. This construction method also enables a vast choice of magnetic elements which can be distributed across the span of the bobbin, essential for establishing similar output levels from strings of very different magnetic permeabilities and mechanical compliances, as commonlyfound in strings used for acoustic instruments.

The secondary coil 28 can be mounted in numerous locations within the instrument's body, such as the inner surface of the instrument's back. In this configuration, it will be appreciated that the sensing and secondary coils 24 and 28 can be disposed to lie in planes that are substantially parallel. It should also be noted that a secondary coil 28 can be integrated as an extension of the sensing coil 24. In this case, the offset (non-coaxial) center points 30 and 32 of the coils 24 and 28 are retained; the degree of differentiation of turns of wire if any would be determined by the relative physical sizes. If this form is used, the mounting device 12 can have an outer peripheral shape other than circular, for example, in cases in which the instrument has a noncircular sound hole or lacks a sound hole, as in the case of solid body electric guitars.

Figure 10:
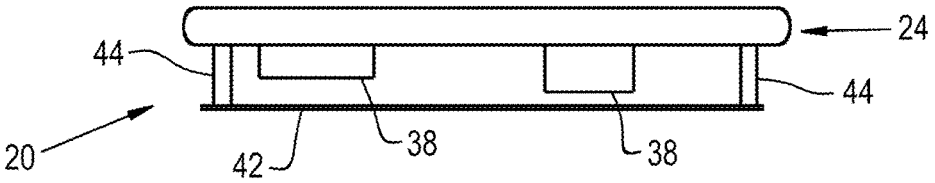
FIGS. 10 and 11 schematically represent an alternative sense coil and an alternative secondary coil, respectively, of a magnetic pickup system.

FIG. 10 schematically represents yet another embodiment of the sensing element 20 comprising a core 22 and sensing coil 24, in which optional supplemental magnets 38 are disposed outside of the core 22 between the core 22 and a thin permeable plate 42 (e.g., formed of a ferrous material), the latter of which is spaced apart from the core 22 with spacers 44, for example, flexible spacers 44 that can suspend the plate 42 from the rear/bottom of the core 22 in such a way that the entire sensing element 20 can integrate acoustical variations generated by the moving body boundaries into the signal.

Figure 11:
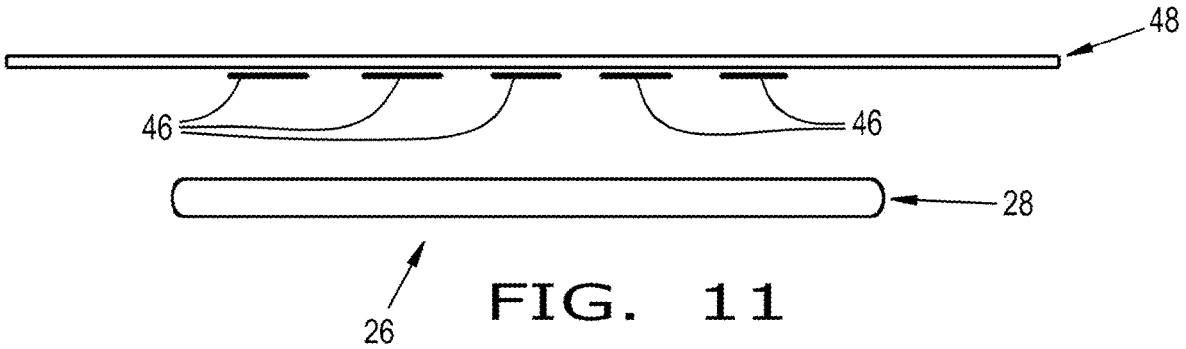

FIG. 11 schematically represents another embodiment of the secondary coil 28 that enables establishing changes in magnetic flux in the secondary coil 28 through the addition of an arrangement of magnetic elements 46. These elements 46, for example, permanent magnets, permeable strips, or some combination thereof, can be arranged to be either in contact with the instrument's top 48 or, as in the case of the sensing coil 24 of FIG. 10, form a dynamic microphone system sensitive to air movement within the body 50 of the instrument, for example, by placing the elements 46 on the inner or outer surface of the instrument top 48 (i.e., within or outside the instrument body 50), and placing the secondary element 26 within the instrument body 50 in close proximity to the instrument top 48. Optionally, permanent magnets (not shown) can be placed on the secondary element 26. It will be appreciated that in the case of attaching the magnetic elements 46 to the instrument top 48, considerable tuning of the response of the pickup system 10 can be achieved through careful selection of the material, size, shape, permeability, and number of the elements 46.

It will be appreciated from the above that one or both coils 24 and 28 of FIGS. 10 and 11 can be configured to serve two purposes. In the case of FIG. 10, the sensing coil 20 can serve as a sensor of both string movement as previously described and also as a dynamic microphone. In the case of FIG. 11, the secondary coil 28 can serve as both a noise cancellation element and also as a sensor of either air movement within the body 50 or movement of the instrument top 48. In these cases, it can be seen that the basic system architecture is adaptable to a wide range of transducing tasks through the efficient use of available resources intrinsic to its design.

Figure 12:
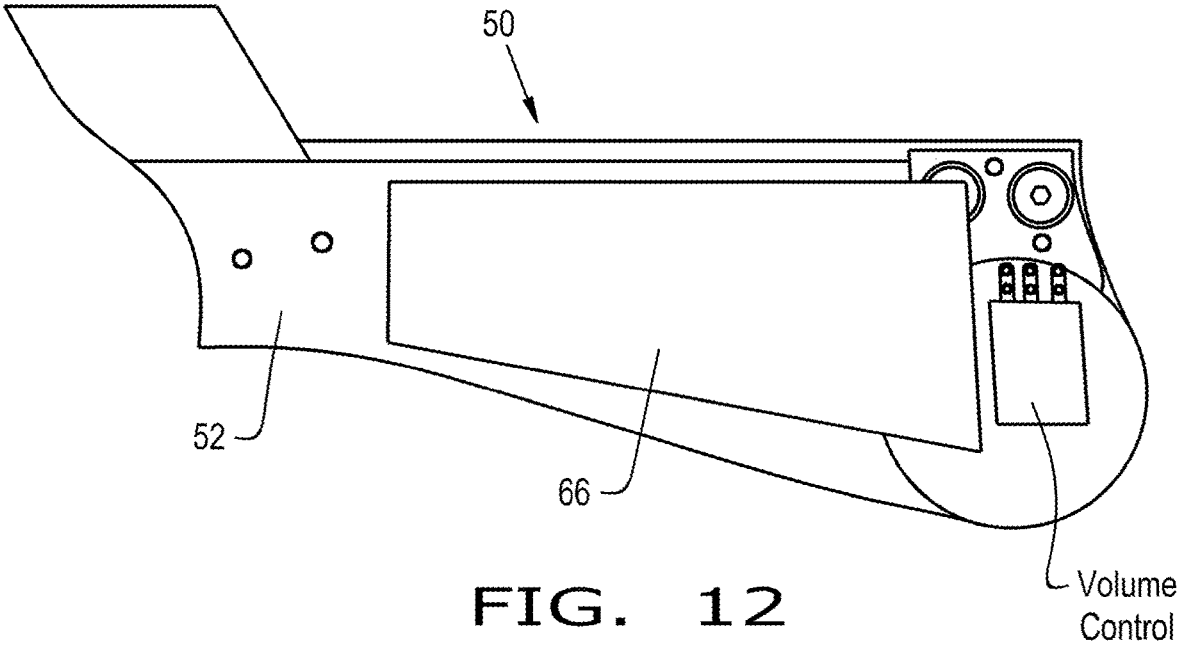
FIGS. 12 through 15 show aspects of a second nonlimiting embodiment of a magnetic pickup system intended for use with a stringed acoustic instrument that lacks a sound hole.

FIGS. 12 through 15 show aspects of a second nonlimiting embodiment of a magnetic pickup system 50 intended for use for amplification of stringed instruments without sound holes, such as but not limited to arch top guitars. As with the prior embodiments of FIGS. 1 through 11, the embodiment of FIGS. 12 through 15 also retain the feature of having sensing and secondary elements with sensing and secondary coils that are offset or non-coaxial relative to each other, in other words, having offset center points 70 and 72. FIG. 12 shows the back side view of a mounting device 52, depicted as a pickguard configured for mounting under a conventional suspended pick guard or finger rest. FIG. 12 further shows a secondary element 66 mounted to the interior (concealed) surface of the mounting device 52 (pickguard) when mounted to an instrument.

Figure 13:
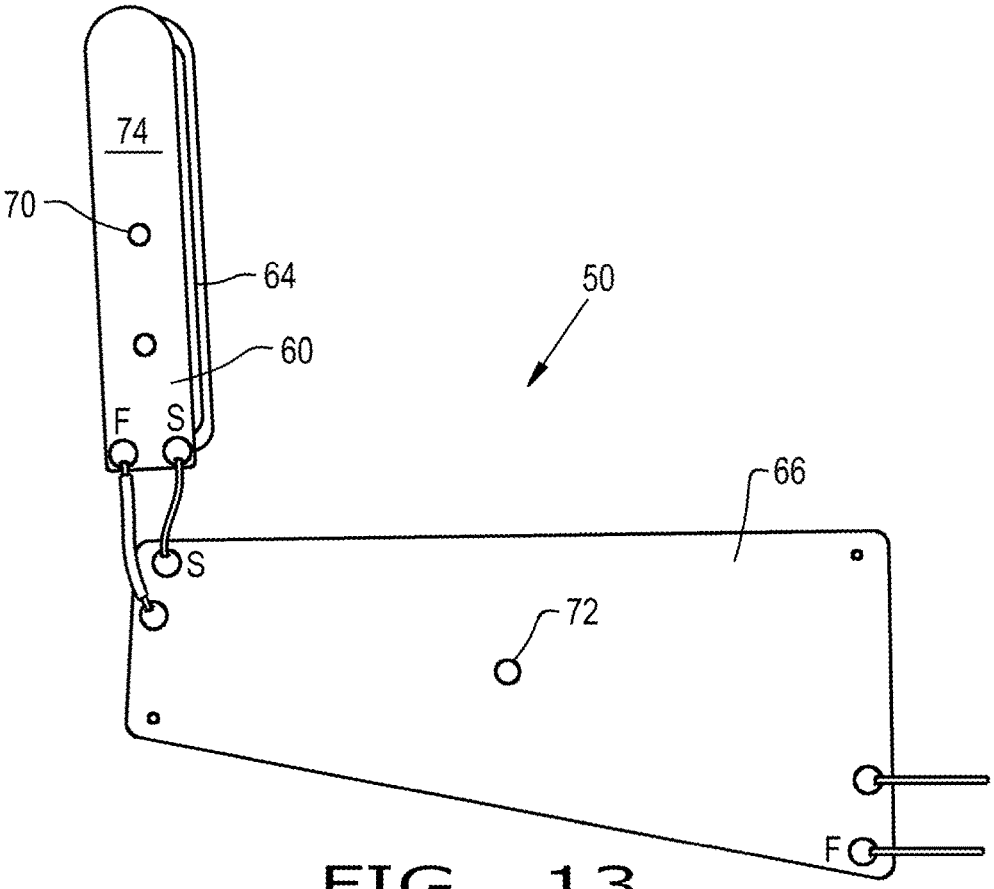

FIG. 13 shows an isolated view of the secondary element 66 of FIG. 12 to which a sensing element 60 has been electrically coupled prior to installation on the mounting device 52 (pickguard) of FIG. 12. The sensing element 60 can be similarly constructed to the sensing elements 20 of FIGS. 1 through 11, in other words, configured as an oblong bobbin comprising a pair of panels 74 and 76, magnets and inert materials (not shown) mounted to and between the panels 74 and 76, and a sensing coil 64 wound around a periphery thereof. The secondary element 66 can also be similarly constructed to comprise a pair of panels (for example, circuit boards), one or more inert materials (not shown) between the panels, and a secondary coil wound to be located at or near a periphery defined by the panels.

Figure 14:
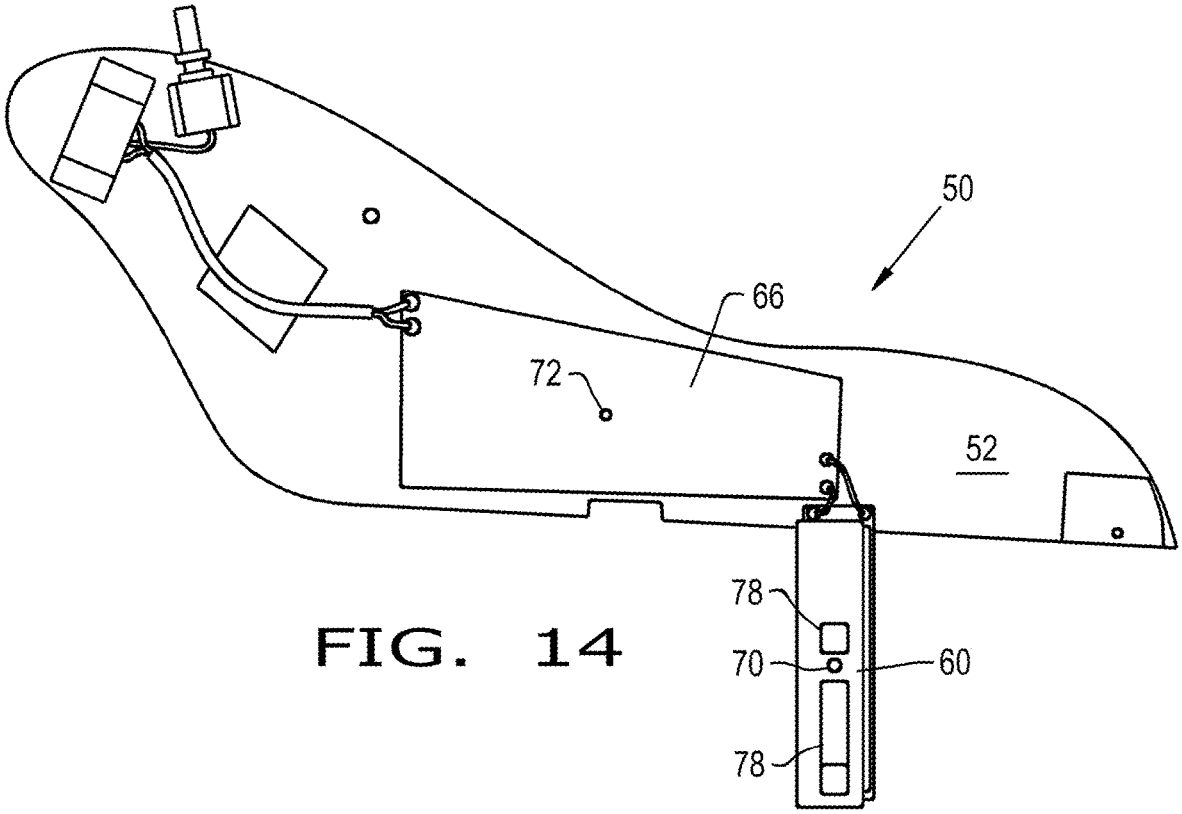
Figure 15:
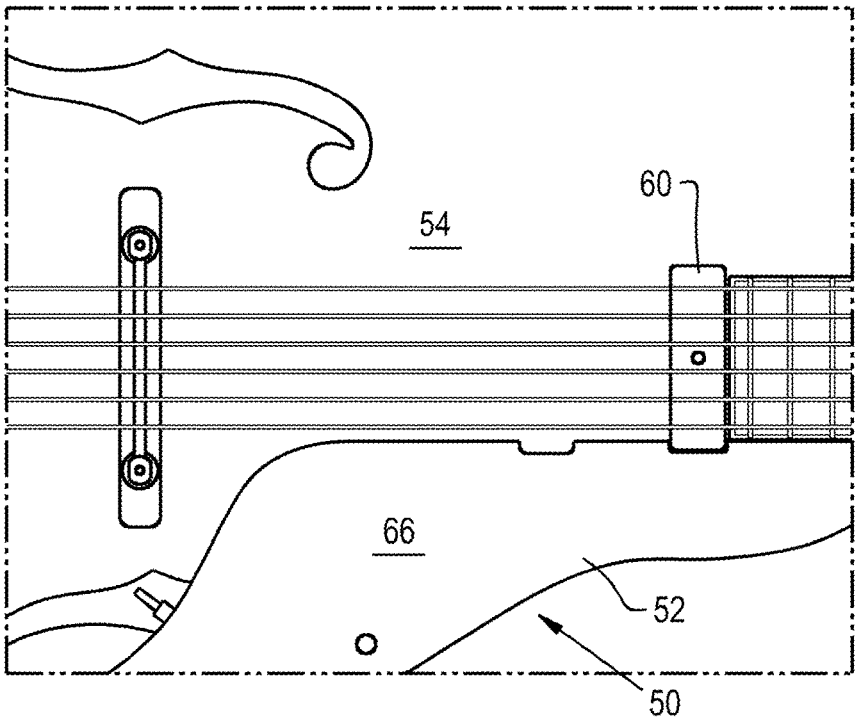

FIG. 14 shows an essentially complete pickup system 50 comprising the sensing and secondary elements 60 and 66 of FIG. 13 secured to the back side of the mounting device 52 (pickguard) of FIG. 12. In this embodiment, the sensing element 60 is shown as including optional exterior-mounted magnets 78. FIG. 15 shows a front view of the mounting device 52 as secured to a stringed instrument 54 (in this example, a guitar). As represented in FIGS. 14 and 15, the sensing element 60 is secured to the mounting device 52 (pickguard) with the secondary element 66 (visible in FIG. 15 through a translucent pickguard) so that the sensing element 60 is cantilevered from the mounting device 52. As evident from FIG. 15, once the pickup system 50 is mounted to the stringed instrument 54, the sensing element 60 is located directly below and transverse to the strings of the instrument 54. In the embodiments of FIGS. 12 through 15, the mounting device 52 may be secured to the instrument 54 such that the mounting device 52 is spaced apart from an exterior surface of the instrument 54 to provide sufficient space to accommodate its secondary element 66. As evident from FIGS. 14 and 15, the coplanar arrangement of the sensing and secondary elements 60 and 66, pickguard, controls, and output jack/lead can be conveniently integrated into a removable module (similar to the previously described pickup system 10 for instruments with substantially round sound holes) that can be moved from instrument to instrument, therefore allowing the owner of multiple instruments to use a single module for all of their similar instruments.

While the invention has been described in terms of specific embodiments, it should be apparent that alternatives could be adopted by one skilled in the art. For example, the magnetic pickup systems and their components could differ in appearance and construction from the embodiments described herein, functions of certain components of the systems could be performed by components of different construction but capable of a similar (though not necessarily equivalent) function, and various materials could be used in the fabrication of the systems and/or their components. In addition, the invention encompasses additional or alternative embodiments in which one or more features or aspects of a particular embodiment could be eliminated or two or more features or aspects of different disclosed embodiments could be combined. Accordingly, it should be understood that the invention is not necessarily limited to any embodiment described herein or shown in the drawings. It should also be understood that the phraseology and terminology employed above are for the purpose of describing the disclosed embodiments, and do not necessarily serve as limitations to the scope of the invention. Therefore, the scope of the invention is to be limited only by the following claims.

The invention claimed is:

1. A pickup system for an acoustic instrument having strings, the system comprising:

a mounting device configured to be coupled with the acoustic instrument;

a sensing element secured to the mounting device and configured to convert mechanical vibrations produced by the strings of the acoustic instrument into an electrical signal, the sensing element including a first coil wound about a first center point; and a secondary element secured to the mounting device and configured to reduce pickup of noise produced by sources other then the strings of the acoustic instrument by the sensing element, the secondary element including a second coil wound about a second center point;

wherein the mounting device is configured to be secured within a sound hole of the acoustic instrument and the mounting device has a passage to allow air flow therethrough;

wherein the sensing element is located within a perimeter of the second coil of the secondary element and the first and second center points are offset from one another.

2. The pickup system of claim 1, wherein the mounting device has a circular shape and the sensing element is disposed on a chord of the circular shape.

3. The pickup system of claim 1, wherein the sensing element comprises a bobbin around which the first coil is wound, the bobbin comprising a pair of panels that are spaced apart and accommodate at least one inert material therebetween.

4. The pickup system of claim 3, wherein the sensing element further comprises one or more permanent magnets located between the panels and/or on an exterior surface of one or both of the panels.

5. The pickup system of claim 3, wherein the panels are fabricated from circuit boards each having a copper layer on a surface thereof.

6. The pickup system of claim 1, wherein the second coil is wound about a periphery of the mounting device.

7. The pickup system of claim 1, wherein the mounting device comprises a plug, door, or window configured to be removably secured within the passage to close the passage and prevent air flow therethrough.

8. A pickup system for an acoustic instrument having strings, the system comprising:

a mounting device configured as a removable module to be removably coupled with the acoustic instrument and can be moved from the acoustic instrument to another acoustic instrument;

a sensing element secured to the mounting device and configured to convert mechanical vibrations produced by the strings of the acoustic instrument into an electrical signal; and a secondary element configured to reduce pickup of noise produced by sources other then the strings of the acoustic instrument by the sensing element;

wherein the mounting device is configured to be secured to the acoustic instrument to locate the sensing element beneath the strings of the acoustic instrument; and if the acoustic instrument is equipped with a sound hole, the mounting device is configured to be removably placed in the sound hole to locate the sensing and secondary elements over the sound hole and beneath the strings of the acoustic instrument; and if the acoustic instrument lacks a sound hole, the mounting device is configured to suspend the secondary element from a pick guard or finger rest of the acoustic instrument and locate the sensing element beneath the strings of the acoustic instrument.

9. The pickup system of claim 8, wherein the sensing element comprises a first coil wound about a first center point, the secondary element comprises a second coil wound about a second center point, and the first and second center points are offset from one another.

10. The pickup system of claim 8, wherein the sensing element comprises a bobbin around which a first coil is wound, the bobbin comprising a pair of panels that are spaced apart and at least one inert material between the panels and/or at least one permanent magnet between the panels and/or on an exterior surface of one or both of the panels.

11. The pickup system of claim 10, wherein the sensing element comprises the at least one inert material and the at least one permanent magnet.

12. The pickup system of claim 10, wherein the panels are fabricated from circuit boards each having a copper layer on a surface thereof.

13. The pickup system of claim 8, wherein the mounting device has a circular shape and the sensing element is disposed on a chord of the circular shape.

14. The pickup system of claim 13, wherein the secondary element has a coil wound about a periphery of the mounting device.

15. The pickup system of claim 13, wherein the mounting device is configured to be secured within a sound hole of the acoustic instrument.

16. The pickup system of claim 15, wherein the mounting device has a passage to allow air flow therethrough.

17. The pickup system of claim 16, wherein the mounting device comprises a plug, door, or window configured to be removably secured within the passage to close the passage and prevent air flow therethrough.

18. The pickup system of claim 8, wherein the mounting device is configured to suspend the secondary element from a pick guard or finger rest of the acoustic instrument and locate the sensing element beneath the strings of the acoustic instrument.

19. The pickup system of claim 18, wherein the secondary element is not beneath the strings of the acoustic instrument.

20. The pickup system of claim 18, wherein the secondary element comprises a bobbin around which a coil is wound, the bobbin comprising a pair of panels that are spaced apart and accommodate at least one inert material therebetween.

21. The pickup system of claim 18, wherein the sensing element is cantilevered from the mounting device.

* * * * *